US006974906B2

(12) United States Patent
Lo

(10) Patent No.: US 6,974,906 B2
(45) Date of Patent: Dec. 13, 2005

(54) LOW INTERFERANCE CABLE

(76) Inventor: Wing Yat Lo, 1st Floor, No. 28 Fu Chang Road, Jiun Du Village, Shen-Kang Hsiang, Taichung (TW)

( * ) Notice: Subject to any disclaimer, the term of this patent is extended or adjusted under 35 U.S.C. 154(b) by 0 days.

(21) Appl. No.: 10/605,434

(22) Filed: Sep. 30, 2003

(65) Prior Publication Data

US 2004/0226738 A1 Nov. 18, 2004

Related U.S. Application Data

(60) Provisional application No. 60/470,301, filed on May 14, 2003.

(51) Int. Cl.[7] ..... H01B 7/34
(52) U.S. Cl. ..... 174/36
(58) Field of Search ..... 174/27, 36, 110 R, 174/113 R, 113 C, 115

(56) References Cited

U.S. PATENT DOCUMENTS 1,720,616 A * 7/1929 Trowbridge ..... 379/415
4,208,542 A 6/1980 Endo
4,413,304 A * 11/1983 Gerry ..... 361/253
4,538,023 A 8/1985 Brisson
4,754,102 A * 6/1988 Dzurak ..... 174/36
4,885,555 A 12/1989 Palmer
4,945,189 A * 7/1990 Palmer ..... 174/32
5,033,091 A * 7/1991 Bond ..... 381/94.6
5,110,999 A 5/1992 Barbera
5,831,210 A 11/1998 Nugent
5,835,979 A * 11/1998 Hiraki et al. ..... 174/33
5,880,402 A * 3/1999 Nugent ..... 174/27
5,929,374 A * 7/1999 Garland ..... 174/28
5,936,203 A * 8/1999 Ryman ..... 174/109
5,965,956 A * 10/1999 Boehme et al. ..... 307/91
6,013,874 A * 1/2000 Gwiazdowski ..... 174/36
6,057,512 A * 5/2000 Noda et al. ..... 174/250
6,225,563 B1 5/2001 Poulsen
6,242,689 B1 6/2001 Budge
6,259,018 B1 * 7/2001 Barnes ..... 174/33
6,265,655 B1 7/2001 Schweighofer
6,266,457 B1 7/2001 Jacob
6,388,188 B1 5/2002 Harrison
6,414,239 B1 7/2002 Gasque, Jr.
6,506,971 B1 * 1/2003 Grach et al. ..... 174/32
6,545,213 B1 * 4/2003 Gabriel ..... 174/36

* cited by examiner

*Primary Examiner*—William H. Mayo, III
(74) *Attorney, Agent, or Firm*—John C. Smith

(57) ABSTRACT

A signal cable lead structure in which each lead inside the cable is formed in a generally rectangular shape such that current passing through each segment of the lead is traveling in the opposite direction from current passing through an adjacent segment of the same lead. As the signal is passing through the signal cable, the magnetic fields generated in each segment of the lead cancels out the magnetic fields in adjacent segments of the lead. In signal cables having multiple leads, the leads are arranged such that they are offset from one another to maximize the distance between the leads, and also rotated in relation to one another to further maximize the distance between the leads.

20 Claims, 10 Drawing Sheets

Prior Art

LOW INTERFERANCE CABLE

CROSS REFERENCE TO RELATED APPLICATIONS

This application is a non-provisional application which claims the benefit of the commonly owned now abandoned provisional application entitled "Low Interference Cable," filed May 14, 2003, bearing U.S. Ser. No. 60/470,301 and naming Lo Wing Yat, the named inventor herein, as sole inventor, the contents of which is specifically incorporated by reference herein in its entirety.

BACKGROUND OF INVENTION

1. Technical Field

The present invention relates to electronic signal cabling devices. In particular, it relates to a cable structure which eliminates the signal interference and distortion caused by frequency shifting in conventional signal cables that transmit audio, video, audio/video, and/or data signals between electronic components.

2. Background

There has been a steady and consistent improvement in the quality in capability of electronic components, such as those used to produce audio data or stereo sound systems, as well as video and audio/video ("AV"). Over many years of progress, the prior art has produced many types of components which are capable of creating exceptionally accurate reproduction's of audio and/or AV works. As electronic components have improved, the signal quality they produce has reached the point where the effect of the cables used to interconnect the components can have a significant effect on the overall quality of the audio or AV output of the system as a whole.

Recognizing that cables can have a noticeable effect on signal output quality, the prior art has attempted to address this issue and to eliminate signal degradation caused by the signal cable when they are connecting system components, by using a variety of techniques. One such technique has been the development of shields which encase the signal leads inside of the signal cable. The use of shields protects the signal leads from external signals which are not generated by the system components As a result, shields have improved overall system performance by protecting signal transfers from being degraded by noise or signals from the external environment.

Another problem often found in data transfer cables, whether used for audio or general data transfer purposes, is signal degradation caused by cable impedance. High impedance cables can reduce received signal strength, and thereby degrade overall system performance. Prior art attempts to reduce this problem included the use of low impedance cabling to interconnect components on stereo systems, home theater systems, and other devices. While the use of low impedance cables has improved signal transfer quality, it only addresses one problem associated with the cable itself.

Another problem associated with signal transfer cables is selective frequency time shifting. This problem is not caused by external factors, or cable impedance, but instead it is created by the signal when it passes through with the cable. In particular, the signal itself can cause degradation due to the magnetic fields it generates during the signal transfer process. The magnetic fields generated by the leads in the cable result in the alteration of the signal. In particular, the magnetic fields generated by the signals themselves have an adverse timing effect on portions of the signals as they travel through the signal cable leads. This timing effect is known as selective frequency shifting. Typically, signal time shifting becomes increases as the frequency increases. As the signals travel through the signal cable, they generate magnetic fields which produce an impedance. This impedance has the effect of increasing the time it takes for selective frequencies to travel through cable, such that signals on different frequencies which simultaneously entered the cable at one end will exit the cable at slightly different times. As a result, a high-quality audio or AV signal produced by the system will have its signal degraded because selective frequencies will travel through the signal cable at a slower rate due to interference generated by the signal itself. At the other end of the signal cable, some frequencies arrive before others. This time delay then prevents the signal from being output as a true reproduction of the signal input at the other end of the signal cable. This time shifting problem has not been adequately addressed by the prior art. It would be desirable to have a method of preventing, or reducing the effects of, selective frequency time shifting.

While the prior art has successfully solved many problems associated with signal transfer via cables, it has not effectively addressed the issue of selective frequency time shifting of signals as the signals travel through data interconnect cables.

SUMMARY OF INVENTION

The present invention provides a novel signal cable structure which automatically reduces or substantially eliminates selective frequency time shifting caused by signals traveling through interconnect cables. The cable uses a unique cable lead structure in which the leads inside the cable are formed in a generally rectangular structure such that current passing through a segment of the signal cable is traveling in the opposite direction from current passing through an adjacent segment of the signal cable. As the signal is passing through the signal cable, the magnetic fields generated in each segment of the signal cable cancel out the magnetic fields in adjacent segments. The cancellation of the magnetic fields eliminates the impedance which causes the selective frequency time shifting to occur. In signal cables having multiple leads, the leads are arranged such that they are offset from one another to maximize distance between the leads, and also rotated to further reduce cross wire interference.

DETAILED DESCRIPTION

Prior to a detailed discussion of the figures, a general overview of the system will be presented. The invention provides a method and apparatus for eliminating distortion and degradation of electronic signals as they are transmitted through the cables. The signals can be electronic signals such as audio data, multichannel or stereo audio data, video data, audio video data, computer data, AC power, or combinations thereof. In addition, any data transmission that is subject to cable related interference also benefits from this invention.

This invention provides a new method of transmitting digital and analog signals in an audio system. Likewise, it can also be used in other systems transmitting analog or digital signals. In general, when an electronic signal is passed through a conductor home it generates a magnetic field around a conductor. The magnetic field has the effect of preventing a change in the magnitude of the signal, and in addition, it also acts to oppose a change in its polarity (an alternating current signal). This is due to local eddy currents which are induced by the magnetic field (i.e., self inductance).

The cable disclosed herein uses leads that are organized in a rectangular fashion so that the magnetic field generated by each segment of lead is offset by the magnetic field generated by an adjacent section of the same wire. Each lead in the cable is organized in the same rectangular fashion and magnetic fields from segments of each lead are used to neutralize the magnetic fields in other sections of the lead. In addition, the each lead in the cable is rotated to minimize cross wire interference, thereby further reducing signal degradation. In the case where two leads are used within a cable, the leads would be rotated 90 degrees from one another and offset such that the distance between each lead is maximized to reduce signal interference. Likewise, in the case where three leads are used in the cable, then each lead would be offset 60 degrees from the previous lead, etc. Having discussed the features and advantages of the invention in general terms, we turn now to a more detailed discussion of the figures.

Figure 1A:
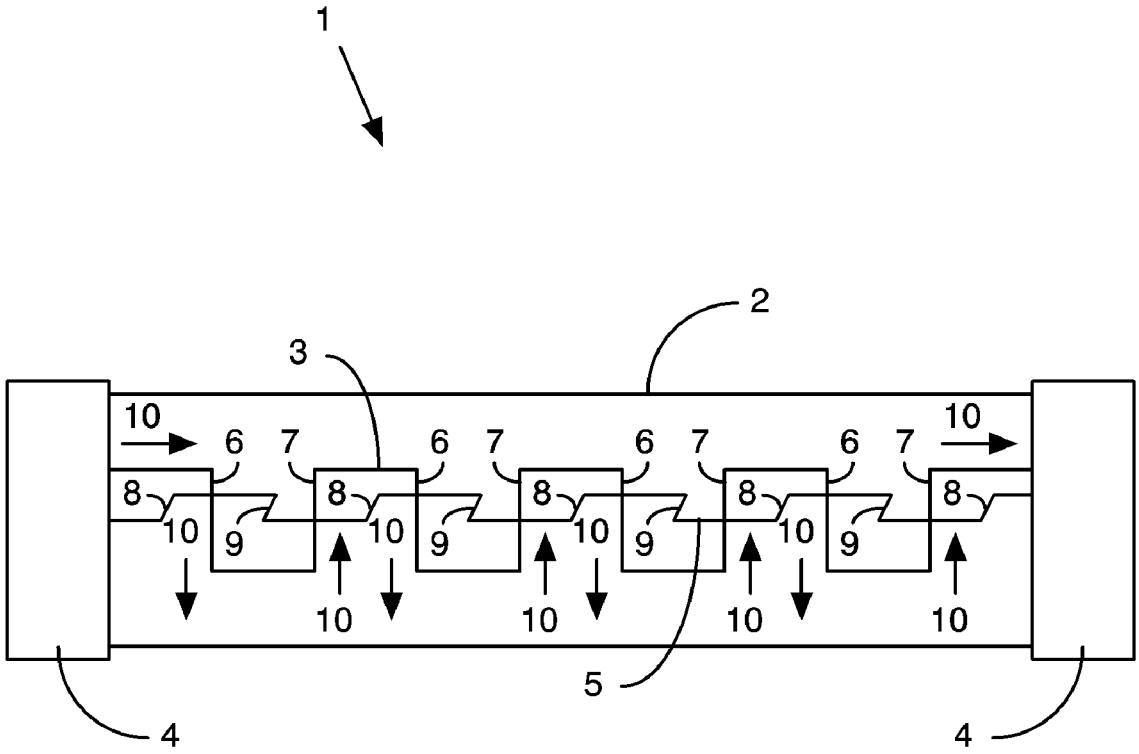
FIG. 1A is a side cutaway view of a preferred embodiment of the invention. This figure illustrates a dual lead cable that has segments of each lead arranged such that current passes through them in the opposite direction of adjacent leads.

In FIG. 1A, a cutaway lengthwise view of a preferred embodiment of the cable 1 is shown. Cable 1 has end connectors 4-each end of cable tube 2. In this figure, the conductors 3, 5 are made into generally rectangular geometric shapes, with each segment 6, 7 of conductor of 3, and each segment 8, 9 of conductor 5, substantially parallel to one another. When arranged in this parallel fashion, the electronic signal 10 passing through each segment 6, 7, and each segment 8, 9 has the same magnitude and polarity since they are merely different sections of the same conductors 3, 5. However, due to the parallel arrangement of the segments 6, 7 and 8,9, the direction of travel of the signals 10 is opposite in each of the segments 6, 7 and 8,9. Because the signals 10 are traveling in opposite directions, the effect is to nullify the self inductance in each of the segments 6, 7 and 8,9. As a result, any electronic signals 10 can in the process of switching, either on or off for digital signals, or switching polarity or AC signals, will have a much smoother pathway through the cable 1 since the dynamic impedance is much lower than it would be in a conventional cable having a straight conductor.

In the case of an audio signal (i.e., an AC signal from 20 Hz to 20,000 Hz in various combinations, and constantly changing in amplitude), the cable 1, due to its reduced self inductance, will have a reduction in group delay. Group delay is the phenomenon wherein different frequencies travel through a conductor at different speeds as a result of self inductance. If the self inductance is reduced, as it is in the preferred embodiment, the audio signal will have better time accuracy for the various frequencies. This results in enhanced dynamic response, better 3-D presentation, and more natural tonal quality.

The basic form of the preferred embodiment uses a cable 1 that has end connectors 4 which connect two signal leads 3, 5. The mechanical structure of the cable is fabricated as a Teflon (TM) tube 2, which encases two conductors 3, 5 which are rotated such that they are substantially at right angles to one another. The Teflon tube 2 is preferably filled with a nonconductive gel, such as a silicone gel. However, those skilled in the art will recognize that any suitable gel-like material can be used. Likewise, while a Teflon tube is used in the preferred embodiment, those skilled in the art will recognize that any suitable material can be used to fabricate the tube 2.

Rather than being formed as a single straight line, each signal lead 3, 5 is formed as series of substantially parallel segments 6, 7. Each segment 6, 7 is angled at approximately 180 degrees to one another. By so doing, segments 6, 7 are aligned such that they carry current 10 in the opposite physical direction from one another. The arrangement of the segments is such that when adjoining segments are carrying current in the opposite direction, is results in the neutralization of the magnetic fields produced by the conductors 3, 5. In the preferred embodiment, how the conductors 3, 5 are installed in the Teflon tube 2 will vary based on the thickness of the conductors 3, 5.

Figure 1B:
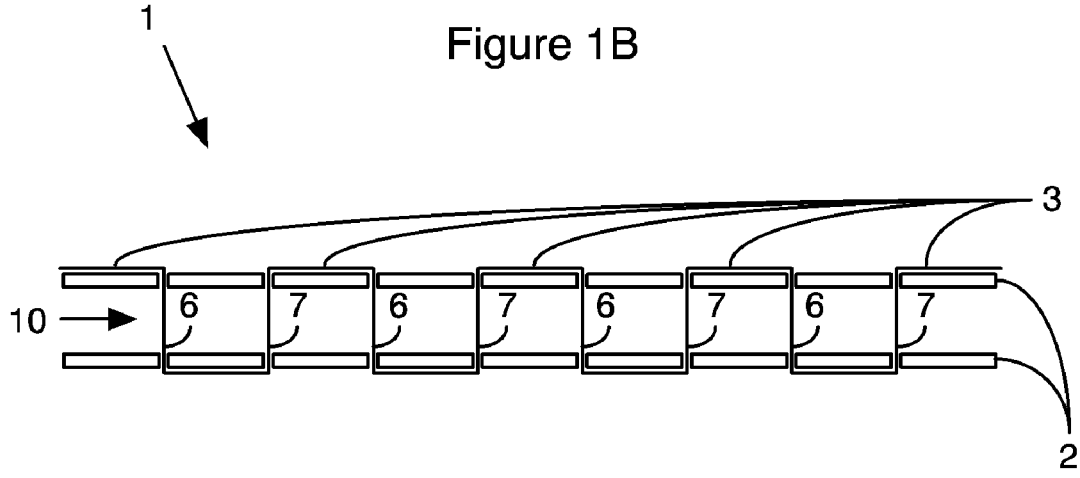
FIG. 1B is a preferred embodiment of the invention, which illustrates a thin gauge conductor thread through the wall of a flexible tube, such as a Teflon tube.

FIG. 1B illustrates the case of a thin conductor 3. For ease of illustration, only conductor 3 is shown in this figure. Any other conductors would also be attached in the same manner. When installing a thin conductor, the special shape of the conductor 3 is fixed by sewing a conductor 3 into the hollow Teflon tube 2 via threads 11. Those skilled in the art will recognize that, in addition to securing the conductor 3 by threading it through the wall of the tube 2, the conductor 3, can be secured to the wall of the tube 2 by any other suitable means, such as adhesives, tape, sewing, etc.

Figure 1C:
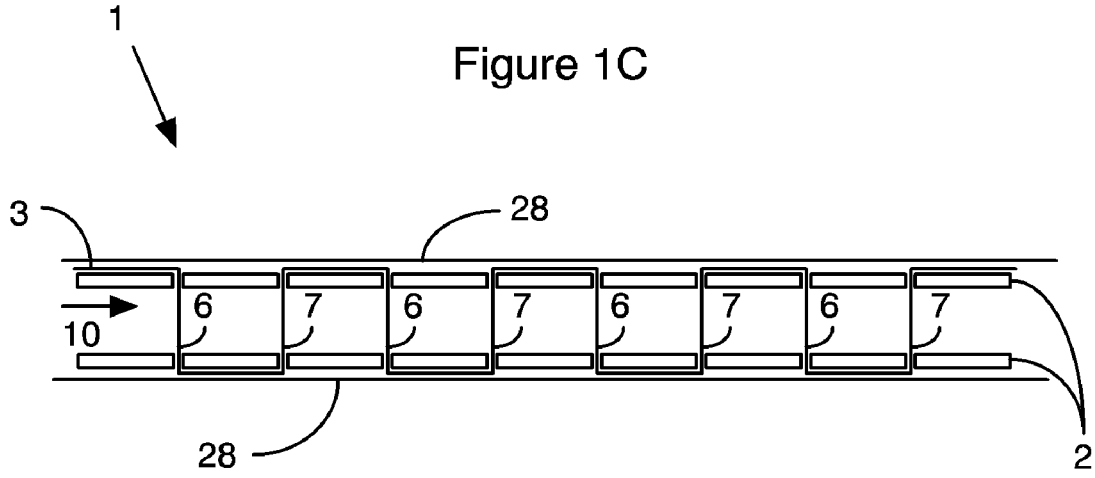
FIG. 1C is a preferred embodiment of the invention, which illustrates the embodiment of FIG. 1 with an optional outer shield to cover portions of the conductor which are on the outside wall of the tube.

In FIG. 1C, the embodiment of FIG. 1B is illustrated encased in an optional outer shield 28 which is used to provide a protective cover for the segments of the conductor 3 which had been threaded to the outside wall of the tube 2.

The outer shield can be very useful in situations where the cable is located in a hostile external environment. The optional outer shield 28 can be fabricated from any suitable flexible and nonconductive material.

Figure 1D:
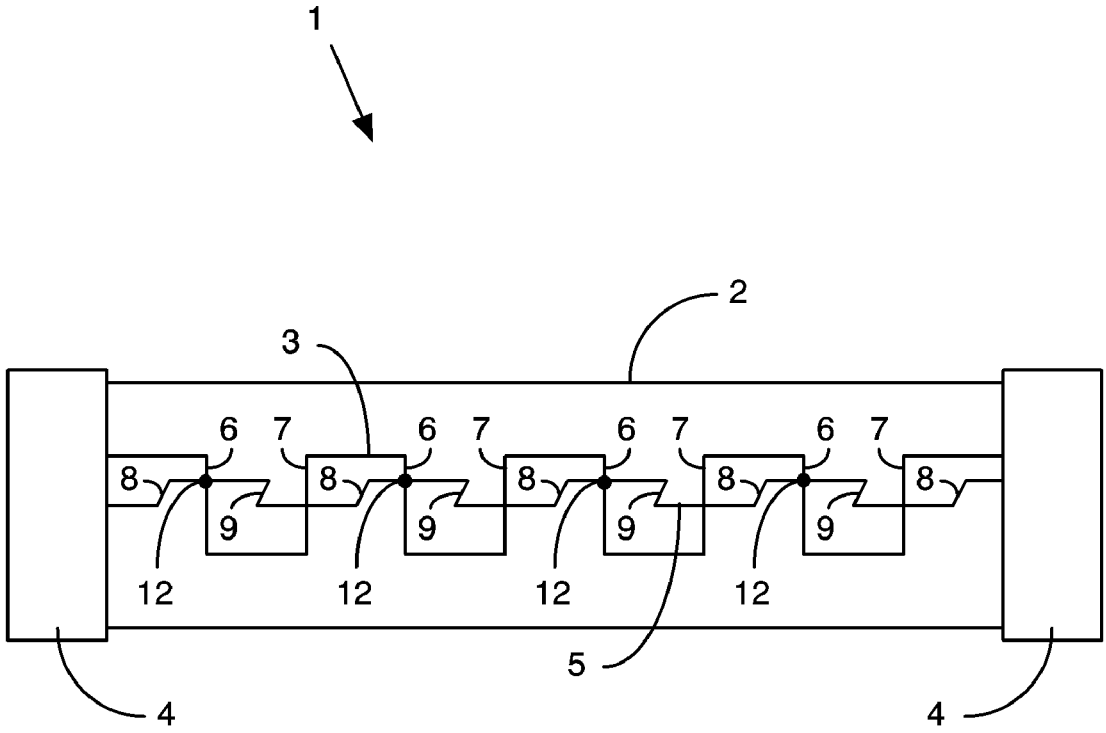
FIG. 1D is an alternative preferred embodiment of the invention, which illustrates heavy gauge conductors secured together.

FIG. 1D illustrates the case of heavier gauge conductors 3, 5. In this embodiment, the conductors have sufficient thickness (e.g., 1.5 mm diameter or greater) that they can be bent into the proper shape and then secured together at approximately 90 degree angles using ties 12. Ties 12 can be fabricated from any suitable material such as nylon strings, Teflon tape, etc.

Once the conductors 3, 5 are installed in the Teflon tube 2, the Teflon tube 2 is then, filled with a semisolid silicon gel, as noted above. The gel's purpose is to control the resonance of the conductors 3, 5.

The elimination of the magnetic fields results in the elimination of selective frequency shifting that occurs in conventional cables. When a conventional cable carries a signal, such as an audio signal, the magnetic fields have a greater or lesser effect based on frequency. This is because signal frequencies will move through the cable at different speeds based on the effect of the magnetic field. Higher frequencies, due to their wavelength, would be more susceptible to error. This frequency time shifting results in a timing problem that prevents accurate reproduction of data, such as audio performances. It also impacts transmission of other types of data. The structure of the cable provided by the invention eliminates this interference, which in turn eliminates unwanted shifts in particular frequency ranges. The invention achieves this result by using the magnetic field produced by the cable to offset itself.

Figure 2:
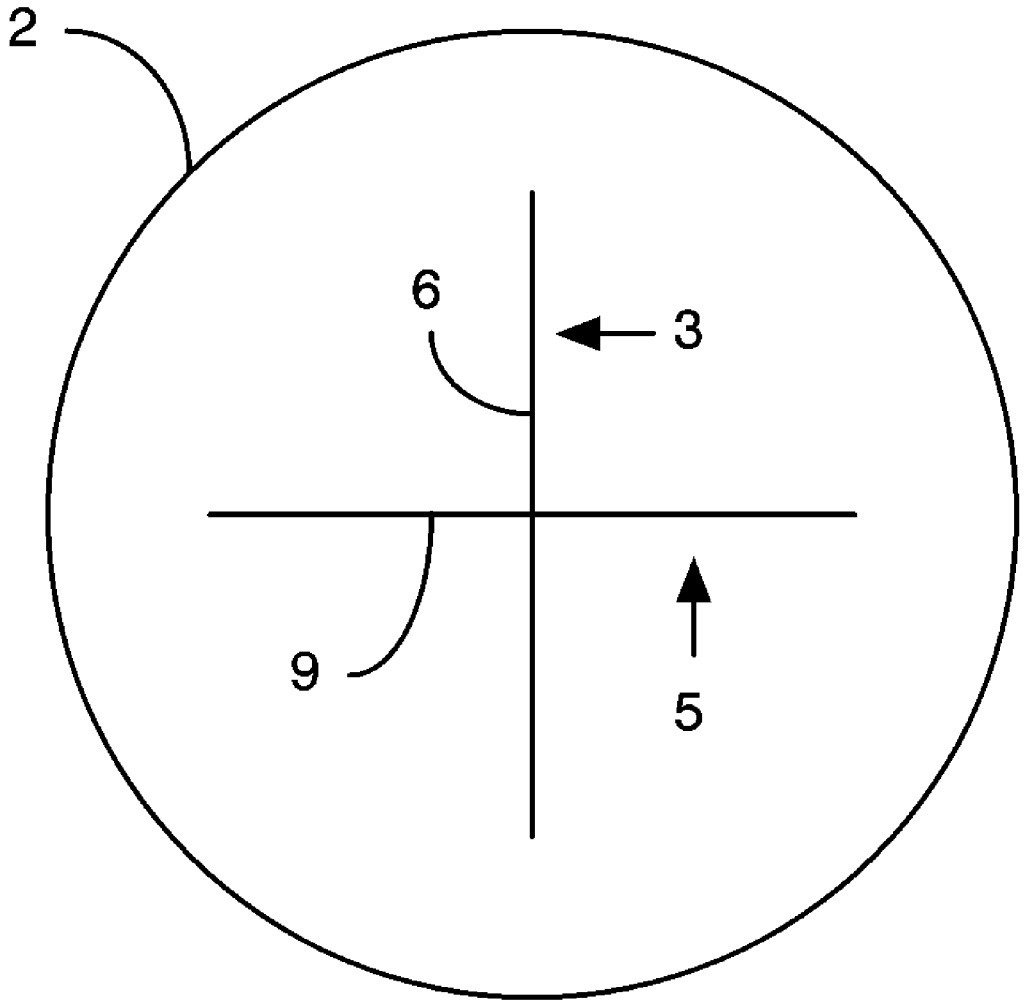
FIG. 2 illustrates an end view of a preferred embodiment of the invention in which a dual conductor cable is arranged such that each of the conductors is rotated approximately 90 degrees from the other conductor.

As shown in FIG. 2,which is an end view of cable 1, the conductor 5 in the cable 1 is arranged in the same manner as conductor 3, with the exception that it is rotated 90 degrees. Segments 8, 9 neutralize each other's magnetic fields in the same manner as segments 6, 7 (discussed above) did. The purpose of rotating leads 3, 5 in regard to one another is that the effect of the magnetic field of one conductor 3 or 5 is minimized on the other conductor 3 or 5. Likewise, it is preferred that segments 8, 9 are positioned between segments 6, 7 such that the distance between each segment is maximized. This further reduces cross-wire interference.

The result of the rectangular structure provided by this invention is that the signal distortion created by selective frequency delay error is reduced or eliminated. This results in a more accurate signal reproduction at the other end of the cable 1.

Figure 3A:
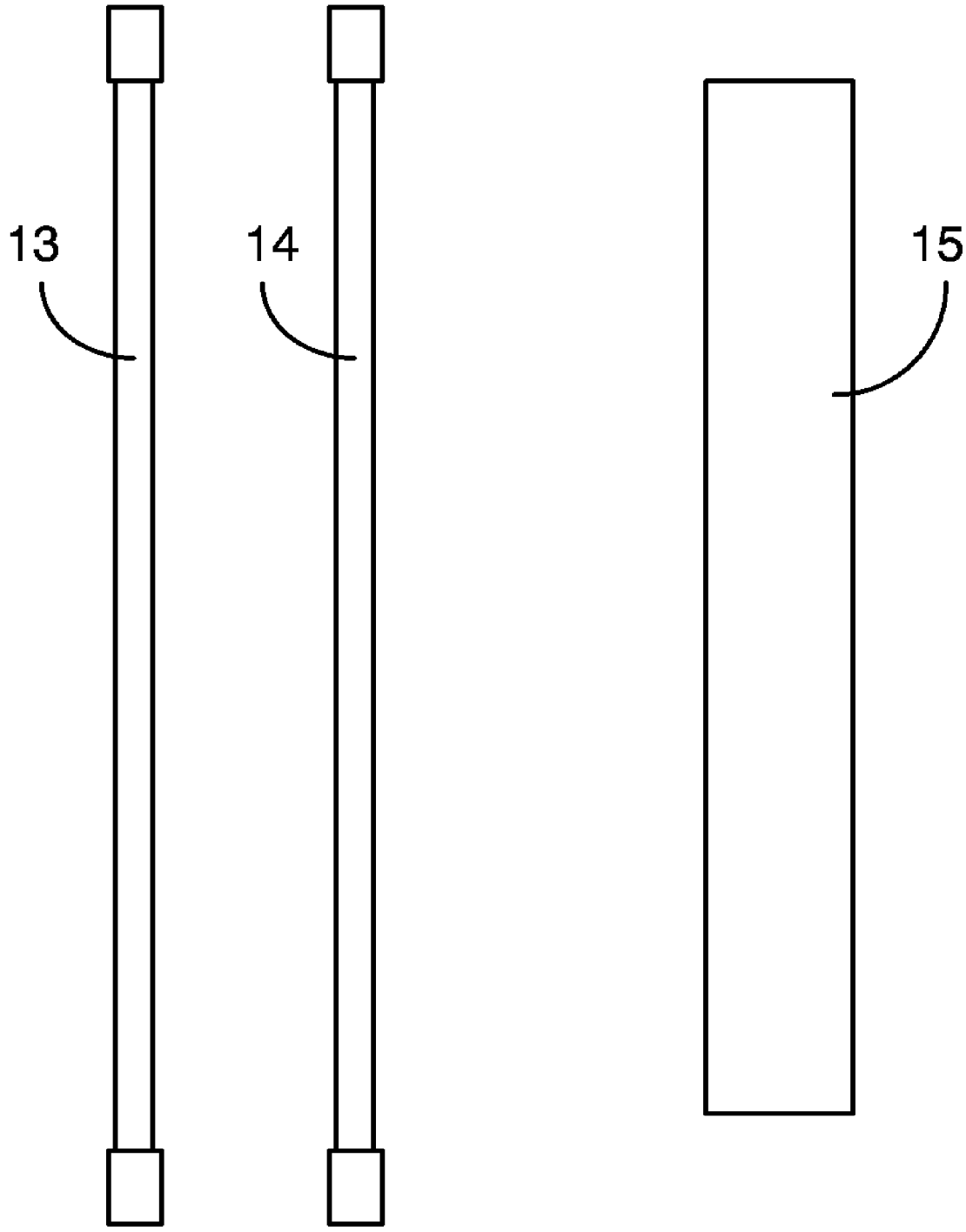
FIG. 3A illustrates an alternative preferred embodiment in which multiple single, dual, or multiple conductor cables are secured to a support tube. This view illustrates the dual conductor cables prior to attachment to the support tube.

FIG. 3A illustrates an alternative preferred embodiment in which multiple dual conductor cables 13, 14 are secured to a support tube 15. Each of the dual conductor cables 13, 14 are equal to the cable 1, discussed above. The support tube may be rigid or flexible. By wrapping the conductor cables 13, 14, around the support tube 15 in a double helix pattern, multiple conductor cables can be routed together with a minimum amount of cross signal interference. For ease of discussion and illustration, only two cables 13, 14 are shown in this figure. However, those skilled in the art will realize that multiple sets of single, dual, and/or multiple conductor cables can be used depending on the particular engineering or technical application.

Figure 3B:
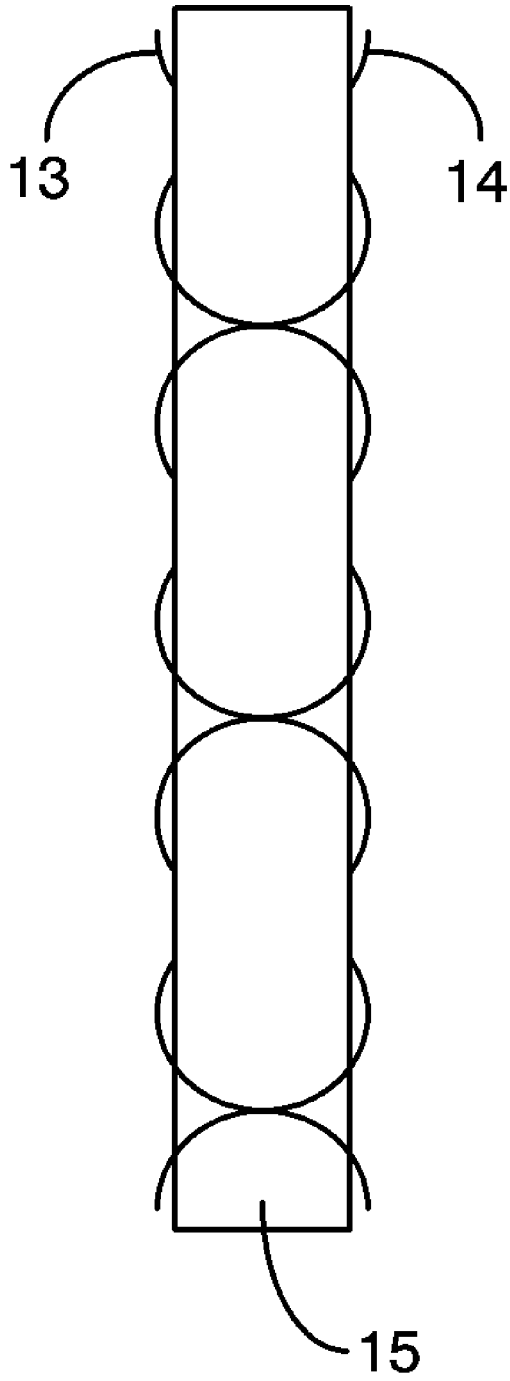
FIG. 3B illustrates the alternative embodiment of FIG. 3A after the single, dual, or multiple conductor cables are assembled onto the support tube.

FIG. 3B illustrates the alternative embodiment of FIG. 3A after the single, dual, or multiple conductor cables 13, 14 are assembled onto the support tube 15. As can be seen, this embodiment allows multiple conductor cables 13, 14 to be routed as part of a single unit. This facilitates ease of installation, and in addition, it maintains separation between the cables 13, 14 to reduce cross signal interference.

For ease of illustration, FIGS. 1A–C and 2 illustrate a dual lead cable 1. However, those skilled in the art will recognize that the benefits and advantages provided by the invention can also be implemented in cable structures having more than two leads, either with multiple conductors embedded within a single cable 1, or with multiple cables 13, 14 attached to a support tube 15 such as that shown in FIGS. 3A–B.

Figure 4A:
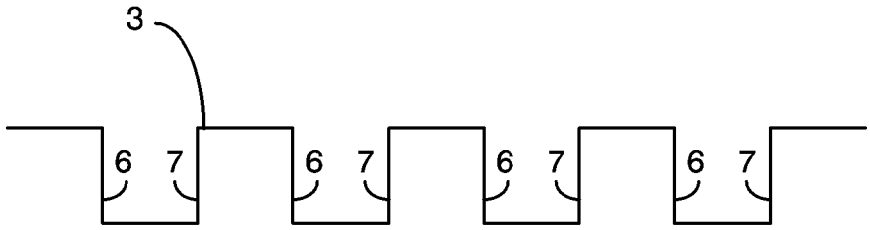
FIG. 4A illustrates the preferred embodiment of the conductor as illustrated in FIGS. 1A–B.

FIG. 4A illustrates the preferred embodiment of the conductor 3 as illustrated in FIGS. 1A–B. As shown in this figure, the segments 6, 7 of the conductor 3 are bent at 90 degree angles. In this configuration, the segments 6, 7 are parallel to one another. This provides the maximum amount of magnetic field cancellation.

Figure 4B:
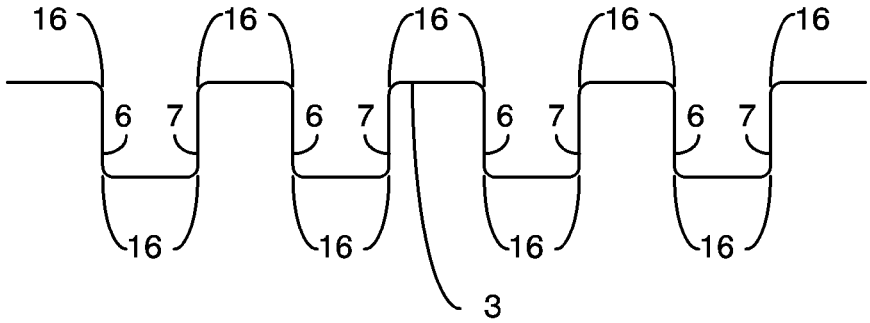
FIG. 4B illustrates another preferred embodiment in which the conductor has rounded bends.

FIG. 4B illustrates another preferred embodiment in which the conductor 3 has rounded bends 16. This embodiment also provides for segments 6, 7 of the conductor 3, which are parallel to one another along substantially the entire length of the segments 6, 7.

Figure 4C:
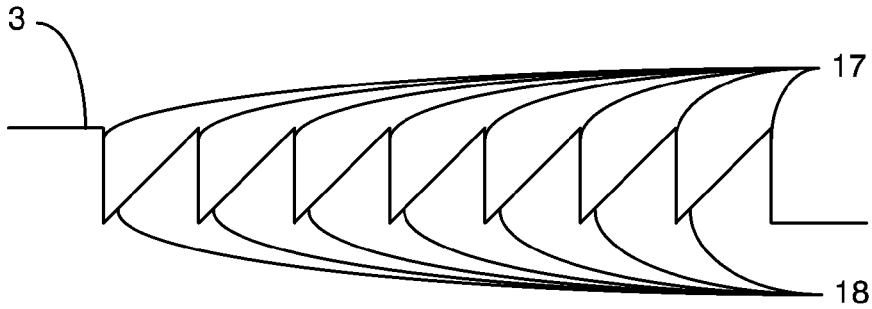
FIG. 4C illustrates another preferred embodiment in which the conductor is formed in a sawtooth pattern.

FIG. 4C illustrates yet another preferred embodiment in which the conductor 3 in which the conductor 3 is formed in a sawtooth pattern. In this configuration, segments 17 and 18 are arranged such that their magnetic fields cancel one another. While not as efficient as the embodiments of FIGS. 4A–B, some reduction in the magnetic field is provided which reduces the effects of frequency group delay.

Figure 4D:
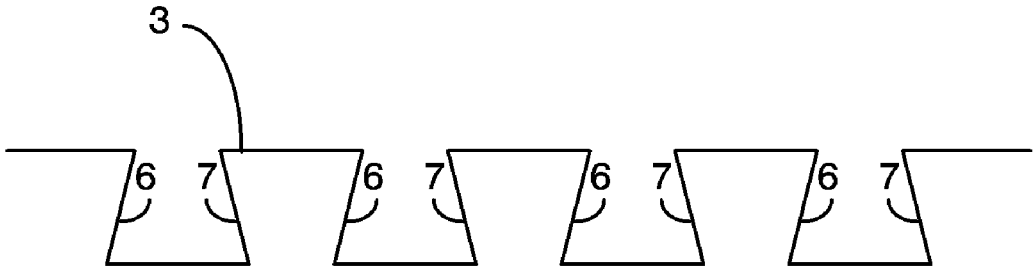
FIG. 4D illustrates yet another preferred embodiment in which the conductor is formed with bends having acute angles.

FIG. 4D illustrates yet another preferred embodiment in which the conductor 3 is formed with the bends having acute angles. As was the case with the previous embodiment, this configuration will also provide reductions in frequency group delay. However, as was the case in regard to the embodiment of FIG. 4C, this embodiment is also not as efficient as the embodiments of FIGS. 4A–B.

Figure 4E:
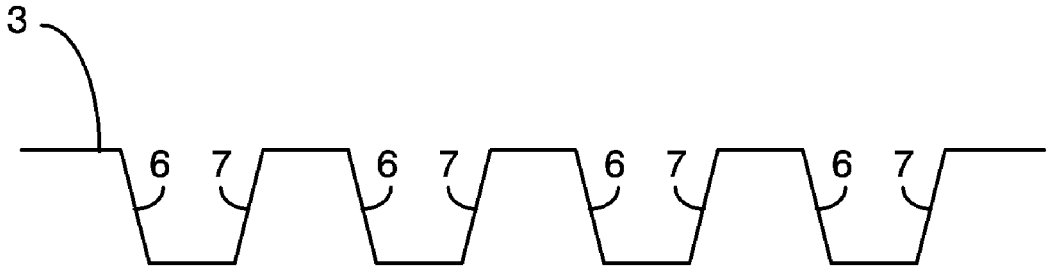
FIG. 4E illustrates yet another preferred embodiment in which the conductor is formed with bends having obtuse angles.

FIG. 4E illustrates yet another preferred embodiment in which the conductor 3 is formed with the bends having obtuse angles. As was the case with the embodiments of FIGS. 4C–D, this configuration will also provide reductions in frequency group delay. Likewise, this embodiment is also not as efficient as the embodiments of FIGS. 4A–B.

The structural examples provided in FIGS. 4A–E are provided for illustrative purposes only. As can be seen from the discussion of FIGS. 4A–E, the benefits of the invention can be realized without restricting the invention to a simple 90 degree rectangular conductor structure such as that used in FIG. 1A. Rather, the conductor 3 can be bent in any convenient form or shape, so long as the segments of the conductor 3 are arranged such that the magnetic field produced by the signal transmitted through the conductor 3 is canceled out by the magnetic fields produced by other segments of the same conductor 3.

Figure 5A:
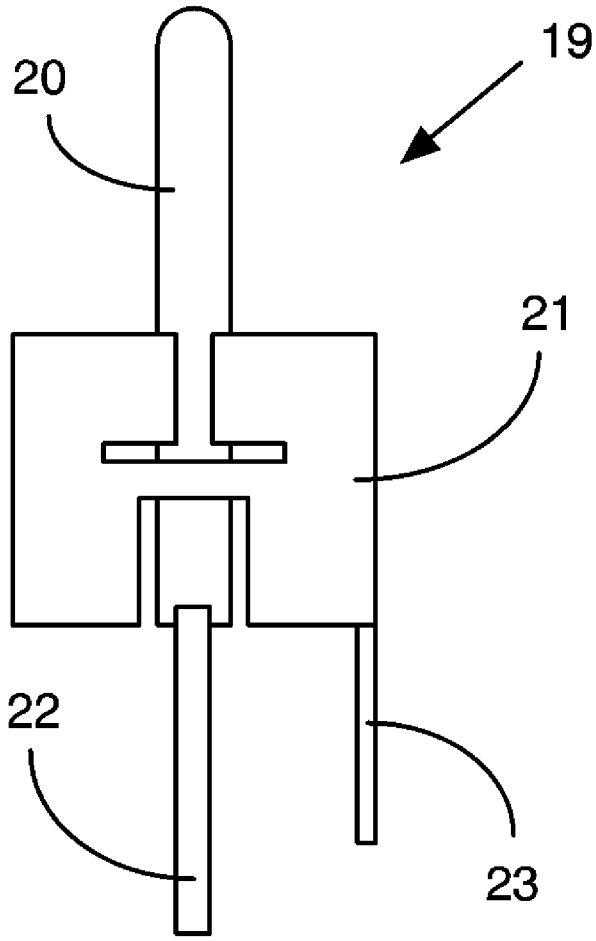
FIG. 5A illustrates a prior art signal connector.

FIG. 5A illustrates a prior art signal connector 19. The signal connector 19 has a solid metal positive contact 20 which is attached to the positive lead 22 of a prior art signal cable. Also shown is the negative contact 21 which is attached to the negative lead 23 of the prior art signal cable.

Figure 5B:
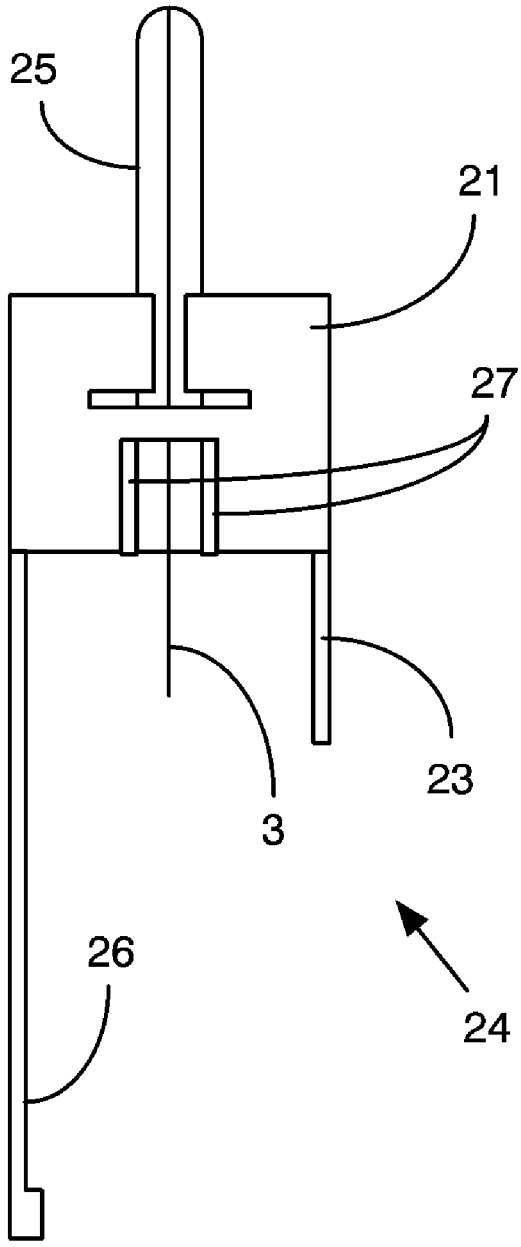
FIG. 5B illustrates a preferred embodiment of a novel connector for use with the low interference cable.

FIG. 5B illustrates a preferred embodiment of a connector 24 for use with the low interference cable 1. This modified connector 24 has a negative contact 21 that is equivalent to the contact 21 of a prior art signal connector 19. In addition, the positive contact 25 as an outer surface which appears to be equivalent to that used in a prior art signal connector 19. However, this connector 24 differs from the prior art in that the positive contact 25 is hollow. This allows the conductor 3 in the low interference cable 1 to be soldered to the tip of the positive contact 25. This minimizes the distance between the conductor 3 and the end of the positive contact 25. In turn, this results in an enhanced sound quality because the shortened distance provides less opportunity for frequency group delay. In the preferred embodiment, the hollow positive contact 25 is also filled with a silicone gel to control resonance.

Also shown is figure is an insulator 27 which is used to isolate the positive contact 25 from the negative contact 23. In addition, a cable grip 26, which is equivalent to those used in prior art cables, is shown.

The low interference cable 1, disclosed therein combines a unique signal cable structure that reduces frequency group delay. It further improves signal quality through the addition of a special connector 24 which reduces frequency group delay generated in the connector.

While the invention has been described with respect to a preferred embodiment thereof, it will be understood by those skilled in the art that various changes in detail may be made therein without departing from the spirit, scope, and teaching of the invention. For example, the material used to construct the cable may be anything suitable for its purpose, the size and shape of the connectors can vary. The number of leads can vary, etc. Accordingly, the invention herein disclosed is to be limited only as specified in the following claims.

I claim:

1. A reduced self inductance signal cable, comprising:

a tube having an internal conduit; and a first conductor located in the internal conduit and having a nonlinear structure in which at least two segments of the first conductor are arranged as adjacent segments of the first conductor and conduct current in opposite physical directions such that the magnetic field in the first adjacent segment negates the magnetic field in the second adjacent segment such that self inductance in the first conductor is reduced;

whereby frequency group delay in the first conductor of a signal cable is reduced due to the reduction in self inductance in the conductor by using one segment of the first conductor to negate the magnetic field of another segment of the same first conductor.

2. A signal cable, as in claim 1, wherein the void in the tube which is not occupied by the first conductor is substantially filled with a gel.

3. A signal cable, as in claim 2, wherein the first conductor is formed such that the adjacent segments of the first conductor are substantially parallel to one another.

4. A signal cable, as in claim 3, wherein the first conductor is bent approximately 90 degree angles such that it forms adjacent segments of the conductor that are substantially parallel to one another.

5. A signal cable, as in claim 4, wherein the first conductor is bent with curved corners.

6. A signal cable, as in claim 2, wherein the first conductor has a substantially sawtooth pattern.

7. A signal cable, as in claim 2, wherein the first conductor is bent such that adjacent segments are arranged that angles that are obtuse or acute to one another.

8. A signal cable, as in claim 2, wherein the structure of the first conductor is held in place by securing means that secure it to the tube.

9. A reduced self inductance signal cable, comprising:

a tube having an internal conduit;

a first conductor located in the internal conduit and having a nonlinear structure in which at least two segments of the first conductor are arranged as adjacent segments of the first conductor and conduct current in opposite physical directions such that the magnetic field in the first adjacent segment negates the magnetic field in the second adjacent segment such that self inductance in the first conductor is reduced;

the void in the tube which is not occupied by the first conductor is substantially filled with a gel;

a second conductor in the internal conduit of the tube; and the first conductor and the second conductor are secured together by ties;

whereby frequency group delay in the first conductor of a signal cable is reduced due to the reduction in self inductance in the conductor by using one segment of the first conductor to negate the magnetic field of another segment of the same first conductor.

10. A reduced self inductance signal cable, comprising:

a tube having an internal conduit;

a first conductor located in the internal conduit of tube and having a nonlinear structure which is arranged such that at least two segments of the first conductor are arranged as adjacent segments of the first conductor such that they conduct current in opposite physical directions in relation to one another such that the magnetic field in the first adjacent segment negates the magnetic field in the second adjacent segment and self inductance in the first conductor is reduced; and a first connector attached to a first end of the signal cable and a second connector attached to a second end of the signal cable, the first and second connectors further comprising:

a negative contact; and a hollow positive contact, the hollow portion of the positive contact having sufficient size such that the conductor can be inserted into the hollow portion of the hollow positive contact and soldered to the hollow positive contact substantially at its end;

whereby frequency group delay in a signal cable is reduced due to the reduction in self inductance in the first conductor, and signal distortion is minimized by reducing the distance between the first conductor and the end of the positive contact.

11. A signal cable, as in claim 10, wherein the void in the tube which is not occupied by the first conductor is substantially filled with a gel.

12. A signal cable, as in claim 11, wherein the first conductor is formed such that the adjacent segments of the first conductor are substantially parallel to one another.

13. A signal cable, as in claim 12, wherein the first conductor is bent at approximately 90 degree angles to form the adjacent parallel segments of the first conductor.

14. A signal cable, as in claim 12, wherein the first conductor is bent with curved corners.

15. A signal cable, as in claim 11, wherein the first conductor has a substantially sawtooth pattern.

16. A signal cable, as in claim 11, wherein the first conductor is bent such that adjacent segments are arranged that angles that are obtuse or acute to one another.

17. A signal cable, as in claim 11, wherein the structure of the first conductor is held in place by securing means that secure it to the tube.

18. A reduced self inductance signal cable, comprising:

a tube having an internal conduit;

a first conductor located in the internal conduit of tube and having a nonlinear structure which is arranged such that at least two segments of the first conductor are arranged as adjacent segments of the first conductor such that they conduct current in opposite physical directions in relation to one another such that the magnetic field in the first adjacent segment negates the magnetic field in the second adjacent segment such that and self inductance in the first conductor is reduced; and a first connector attached to a first end of the signal cable and a second connector attached to a second end of the signal cable, the first and second connectors further comprising;

a negative contact:

a hollow positive contact, the hollow portion of the positive contact having sufficient size such that the conductor can be inserted into the hollow portion of the hollow positive contact and soldered to the hollow positive contact substantially at its end; and the void in the tube which is not occupied by the first conductor is substantially filled with a gel;

a second conductor in the tube; the first and second conductors secured together by ties;

whereby frequency group delay in a signal cable is reduced due to the reduction in self inductance in the first conductor, and signal distortion is minimized by reducing the distance between the first conductor and the end of the positive contact.

19. A method of reducing self inductance in a signal cable, including the step of:

arranging a conductor within a signal cable such that portions of the conductor are positioned in a nonlinear fashion such that segments of the conductor are adjacent to one another and arranged such that current in one of the segments moves in the opposite physical direction of current in the adjacent segment such that the magnetic fields in the adjacent segments negate each other;

whereby structural arrangement of the conductor allows a single signal lead to create the negation of the magnetic fields and reduces self induction and frequency group delay.

20. A method, as in claim 19, including the additional step of reducing resonance by filling the voids inside the signal cable with a gel.

* * * * *